US007909540B2

(12) United States Patent
Leishman

(10) Patent No.: US 7,909,540 B2
(45) Date of Patent: Mar. 22, 2011

(54) PORTABLE SURFACE AIR SUPPLY SYSTEM

(76) Inventor: Hendry R. Leishman, Fife (GB)

( * ) Notice: Subject to any disclaimer, the term of this patent is extended or adjusted under 35 U.S.C. 154(b) by 21 days.

(21) Appl. No.: 12/466,504

(22) Filed: May 15, 2009

(65) Prior Publication Data

US 2009/0285636 A1 Nov. 19, 2009

Related U.S. Application Data

(60) Provisional application No. 61/053,964, filed on May 16, 2008.

(51) Int. Cl.
*B63C 11/20* (2006.01)

(52) U.S. Cl. ..... 405/186; 405/185; 128/201.27

(58) Field of Classification Search ..... 405/185, 405/186; 128/201.27; 114/315
See application file for complete search history.

(56) References Cited

U.S. PATENT DOCUMENTS

| | | | | | |
|---|---|---|---|---|---|
| 3,791,327 | A * | 2/1974 | Deveney | 114/315 |
| 4,510,930 | A * | 4/1985 | Garcia | 128/202.22 |
| 4,729,394 | A * | 3/1988 | Timmes et al. | 134/199 |
| 4,832,013 | A * | 5/1989 | Hartdorn | 128/201.27 |
| 4,919,631 | A * | 4/1990 | Stafford | 405/186 |
| 5,082,464 | A * | 1/1992 | Clink | 114/315 |
| 5,327,849 | A * | 7/1994 | Miller | 405/186 |
| 5,471,976 | A * | 12/1995 | Smith | 128/201.27 |
| 5,524,564 | A * | 6/1996 | Porada | 114/315 |
| 5,906,200 | A * | 5/1999 | Kaburaki | 128/201.27 |
| 5,924,416 | A * | 7/1999 | Miller | 128/201.27 |
| 2009/0000617 | A1 * | 1/2009 | Rosenberger | 128/201.27 |

* cited by examiner

*Primary Examiner* — Frederick L Lagman
(74) *Attorney, Agent, or Firm* — Ward and Smith, P.A.

(57) ABSTRACT

A portable air supply system includes a main frame for nesting paired air SCUBA cylinders therein. Saddle arms are connected for engaging the frame to pontoons of an inflatable boat. A pair of baskets are connected for carrying umbilical lines. A control box controls air flow, monitors diver status, and provides a communication link.

14 Claims, 7 Drawing Sheets

PORTABLE SURFACE AIR SUPPLY SYSTEM

CROSS REFERENCE TO RELATED APPLICATIONS

This application is related to and claims priority to Provisional Application Ser. No. 61/053,964 filed May 16, 2008, the disclosure of which is incorporated herein by reference in its entirety.

FIELD OF THE INVENTION

This invention is related to a portable surface demand system as an alternative to traditional SCUBA (self-contained underwater breathing apparatus) diving equipment. More specifically, the invention relates to an alternative portable surface demand system which employs a diving support vessel ("DSV") which is capable of operating in shallower water depths, and more particularly, to such a system which can be used from a small boat such as an inflatable boat.

BACKGROUND OF THE INVENTION

Many underwater operations are conducted by divers using self-contained underwater breathing apparatus which are conventionally known as SCUBA tanks. However, in many industries such as in the offshore oil industry, the use of SCUBA equipment for conducting underwater operations is banned.

Such a ban was imposed by the International Marine Contractors Association ("IMCA") primarily because of the lack of communications with the surface, and because the limited duration of the air supply which divers employ creates a hazardous situation for divers. Current conventional water communication equipment can be unreliable and interference caused by a ship's propulsion systems, echo sounders, impressed current systems, and other like devices can render such communication devices useless at critical times.

Today, most jobs offshore use a conventional diving support vessel employing a dynamic positioning system ("DPS"). However, the majority of such diving support vessels employing a dynamic positioning system are quite large, and cannot operate in shallower water depths. Moreover, standard diving support vessels cannot operate in areas where there is a high concentration of pipelines prohibiting the use of anchors.

As a result, some form of portable air supply system employed on a small boat has been used in the past in a variety of configurations. Such systems typically employ a heavy metal framework which contains between three to six large air storage cylinders. Such a frame includes a dive control panel and some type of hook or basket arrangement for storage of umbilical tubes (e.g., air supply and communication lines) used by divers, typically by two divers. When employed, the majority of these systems weigh at least one ton or more and requires a crane or forklift to mobilize and deploy.

One disadvantage of such systems is that a great deal of stress is placed on the bottom of an inflatable or other type of boat. Further, since such systems are used in the Civil Engineering industry, a great deal of the work is carried out on docks, inland waterways and reservoirs. Some of the areas in which such systems are required to be used are inaccessible for cranes or forklifts to operate in. Moreover, all of the systems currently in use today suffer from the fact that when the air or gas mixture has been depleted, the boat has to return to a parent vessel to recharge the unit.

In accordance with the features of the invention, the disadvantages of the currently existing portable surface demand systems are avoided, and there is provided a simple to assemble, light weight and easy to deploy system which can maintain a continuous supply of air or gas mixture to a plurality of divers, particularly at least two divers.

SUMMARY OF THE INVENTION

In accordance with the invention there is provided a portable surface air supply system. The air supply system includes a main cylinder frame having a plurality of SCUBA cylinder nesting receptacles for having respective twin SCUBA cylinders received therein. SCUBA cylinders are of a size capable of being carried by an individual and much smaller than the air storage cylinders of prior portable air supply systems. Umbilical tube brackets extend from respective opposite sides of the frame for carrying umbilical tubes therein. By umbilical tubes, it is meant air or gas supply lines, communication lines and lines for connection to monitors on the divers to monitor the divers' physiology or depth. A dive control panel including regulators, depth gauges and cross over valves is connected for controlling air flow for respective divers, monitoring diver depth, and crossing over to a new air supply in the event of the failure of an air supply to a specific diver. The dive control panel also includes attached a communication box or device to ensure communications with the divers.

In a more specific aspect, the control panel also includes life support gauges connectable to the umbilical tubes for monitoring diver physiological status, and further includes gauges for indicating air supply status.

In a more specific aspect, the frame is constructed for holding up to eight air cylinder pairs mounted therein (six horizontally and two vertically), and includes umbilical tubes connectable to the air cylinder pairs through the control panel for supplying air to at least one diver, and typically two divers. Umbilical cord baskets are arranged for being connected to the frame to extend from the frame at respective outboard sides of a vessel. The main cylinder frame includes outboard adjustable pontoon saddle arms having a semi-cylindrical cross-section for being supported in a vessel having outboard inflatable pontoons, to thereby be supported in the vessel on the inflatable pontoons. Typically, such saddle arms are detachable from the main cylinder frame. The main cylinder frame may also include lifting points for connecting lifting lines thereto for allowing the main cylinder frame to be lifted as a whole.

DETAILED DESCRIPTION OF THE INVENTION

Figure 1:
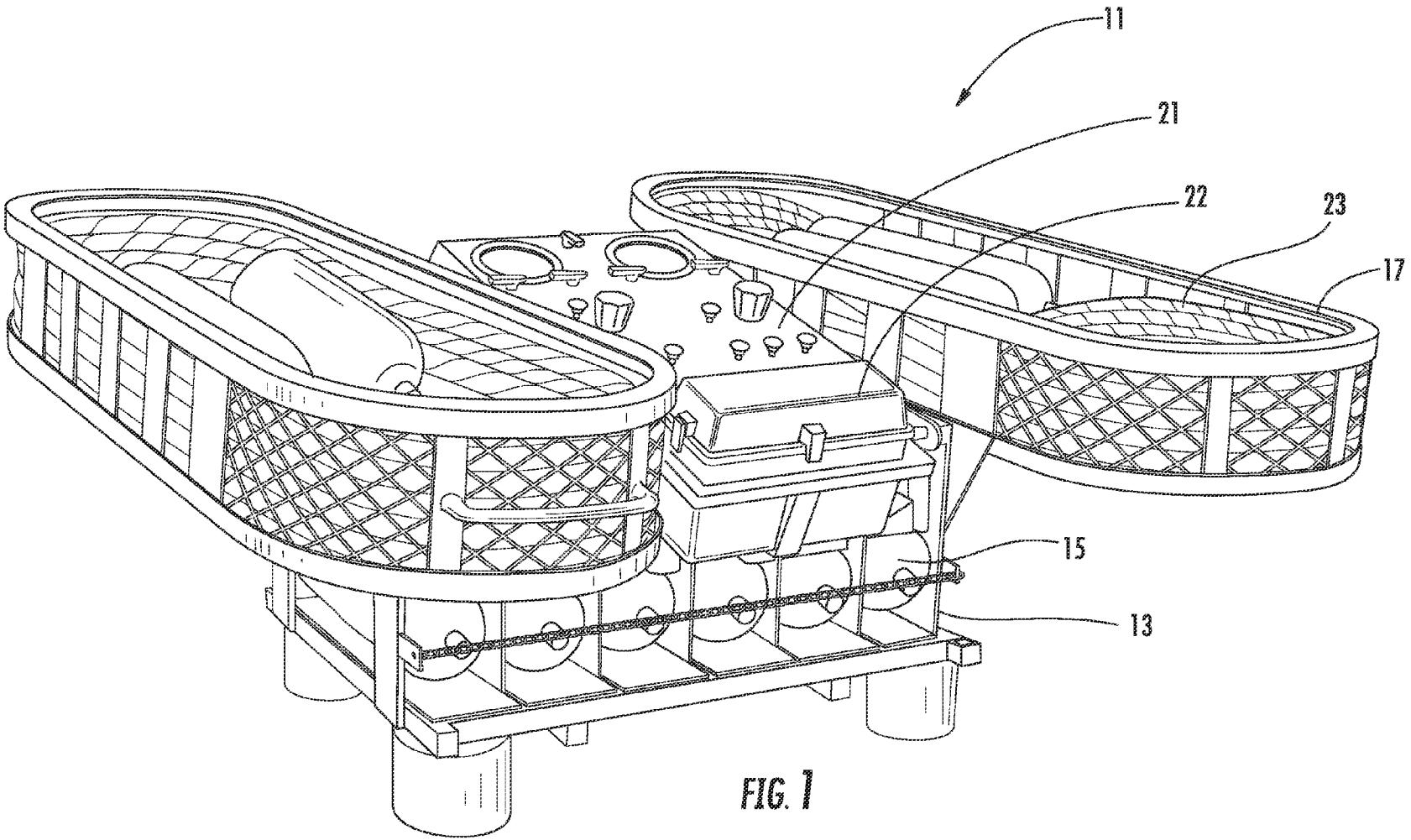
FIG. 1 a perspective view of an assembled system in accordance with the invention.

An embodiment of the invention is illustrated in FIG. 1 in completely assembled form outside of a vessel. Such a vessel may be an inflatable boat such as those which are commercially available under the trademark Zodiac, as well known to those of ordinary skill in the art. The system 11 of the invention includes a frame 13 configured for housing pairs of SCUBA tanks 15 nested within the frame 13. Umbilical tube baskets 17 are attached on outboard sides of the frame 13 for the purpose of storing umbilical tubes which include air supply lines, monitoring lines, and communication lines for use by a diver connected to the system 11. A control box 21 with a communication box 22 is also attached and connected so as to interconnect the umbilical tubes 23, to the control box 21 which includes controls 37 and indicators 35 (FIG. 10), and to the communication box as discussed hereafter. Saddle arms 19 (FIG. 7) extend from underneath the basket 17 and are configured to be supported on the pontoons of an inflatable or similarly constructed boat.

As an example, the frame 13 dimensions, without taking into account the saddle arms 19, are of a width of about 45½ inches, a depth of about 32 inches, and a height of about 31 3/16 inches. The frame 13 is fitted with adjustable pontoon saddle arms 19 (FIG. 7), but illustrated in other figures hereafter. Typically, the frame 13 is made of light weight aluminum material with appropriate fixings and attachments as will be readily apparent to those of ordinary skill in the art, and with welded connections as necessary. Preferably, aluminum 6061 is employed, particularly because of the welding properties and high corrosion resistance. As will also be readily apparent to those of ordinary skill in the art, the frame 13 can be manufactured in two versions. A first version is a fully welded construction. Alternatively, a flat pack version which is bolted together can be constructed as an alternative.

Figure 2:
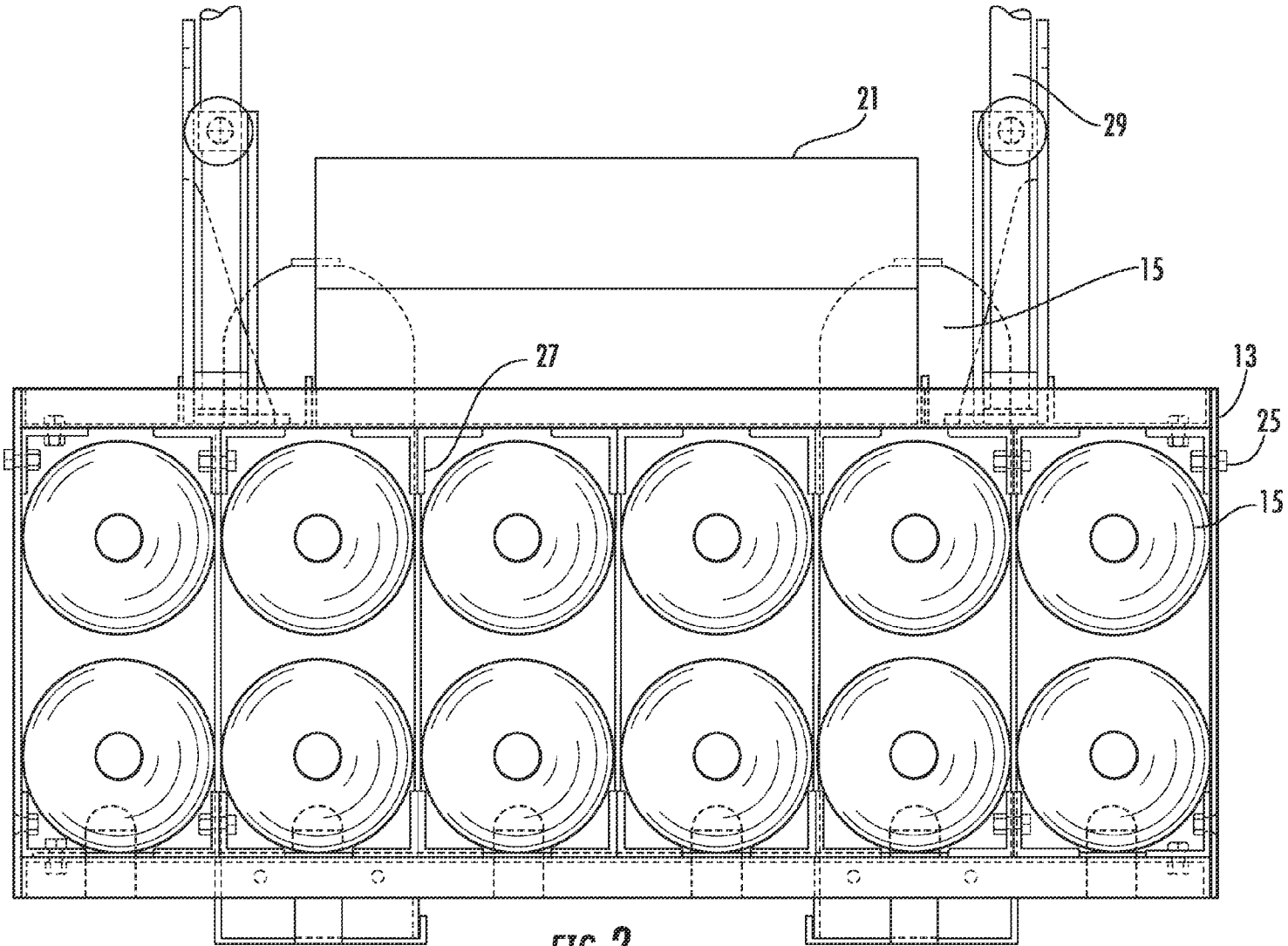
FIG. 2 is a front cross-sectional view showing certain elements in phantom lines of the frame of the system of the invention, and having SCUBA cylinders mounted therein.
Figure 3:
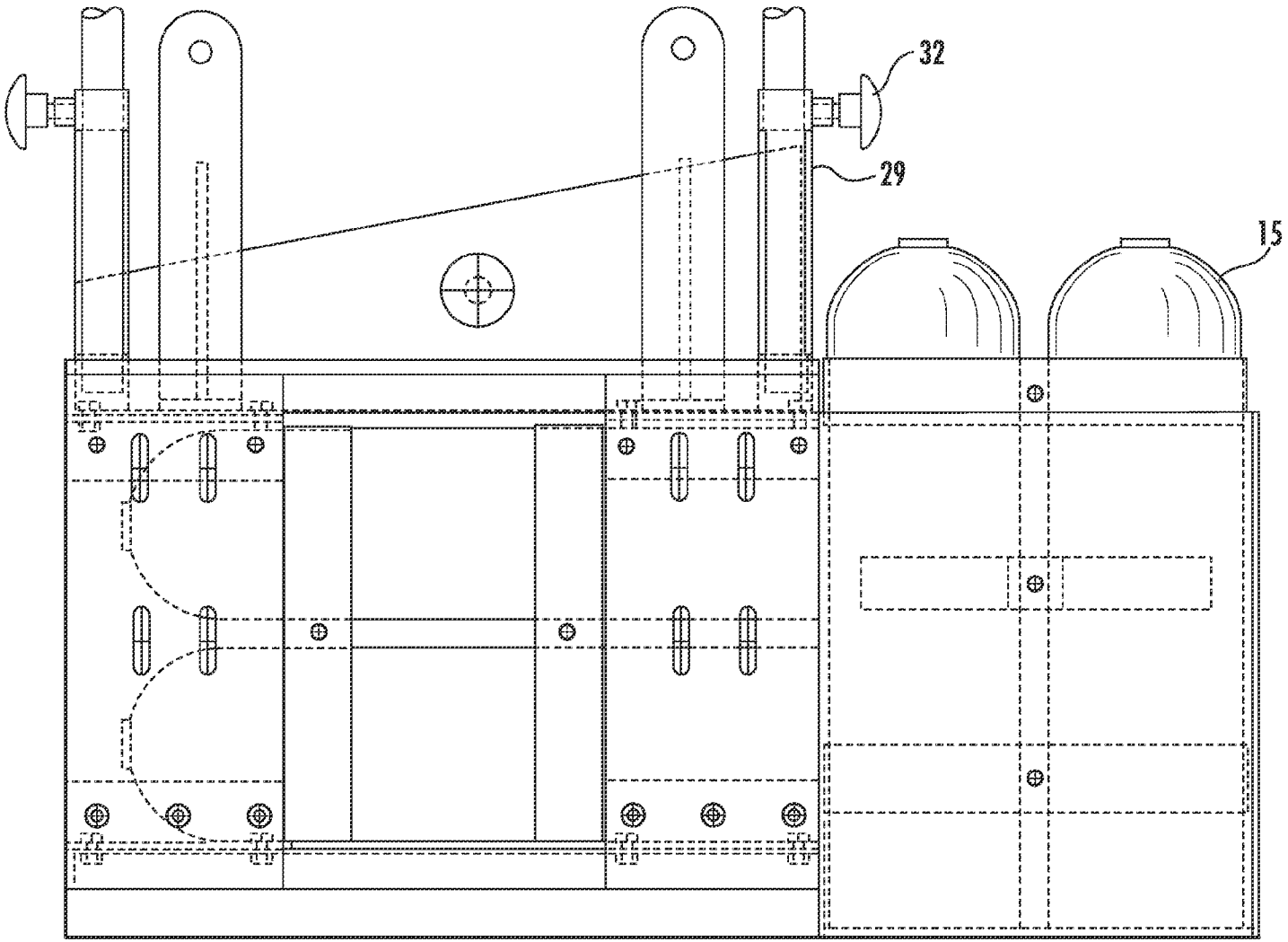
FIG. 3 is a side cross-sectional view of the frame of in FIG. 2.

As designed and illustrated in FIGS. 2 and 3, the frame 13 is capable of carrying eight twin SCUBA cylinder packs 15. Six of the packs 15 are installed within the frame lying on the side in compartments which include dividers 27. In the embodiment of FIG. 2 a bolted frame is illustrated which includes bolts 25 holding the frame 13 together. In addition, a canopy extension 29 can also be provided with screw securing members 32 at four different locations for allowing an adjustable cover to be attached and mounted on the frame 13.

Figure 4:
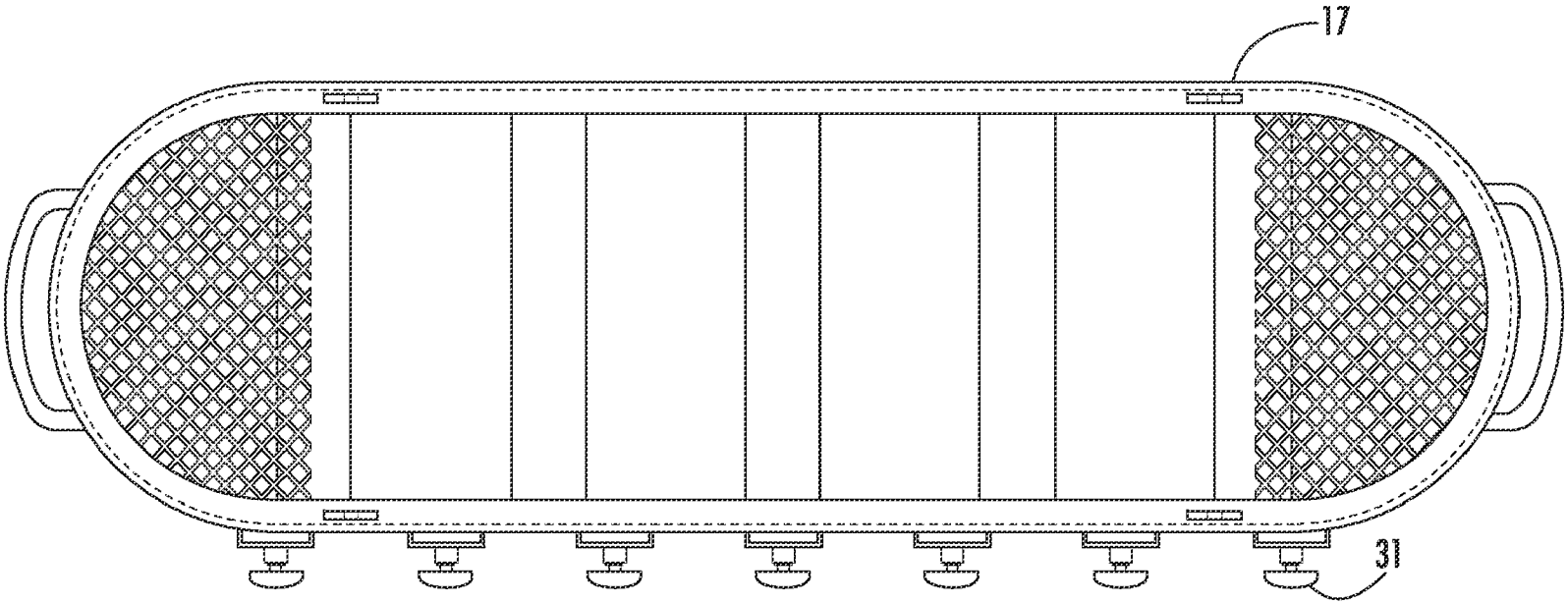
FIG. 4 is a top plan view of an umbilical cord basket of the type deployed in the system.
Figure 5:
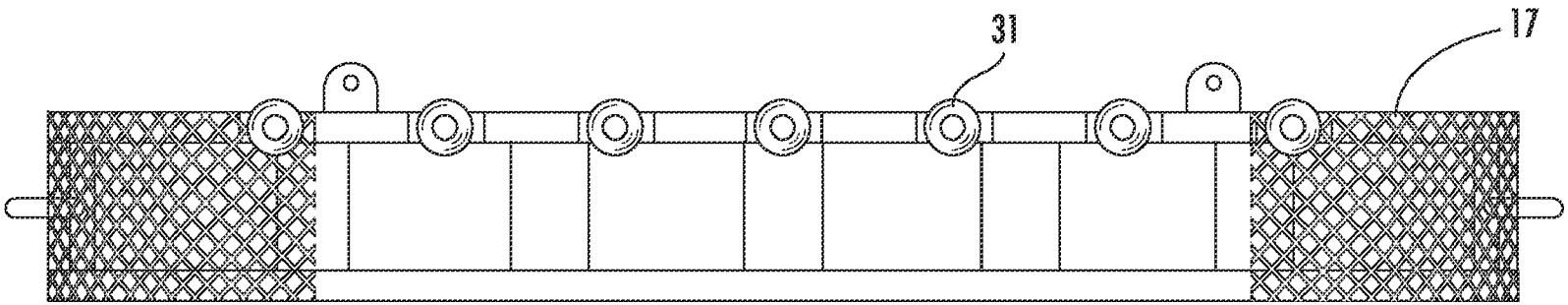
FIG. 5 is a side partial cross-sectional view of the basket of FIG. 4.
Figure 6:
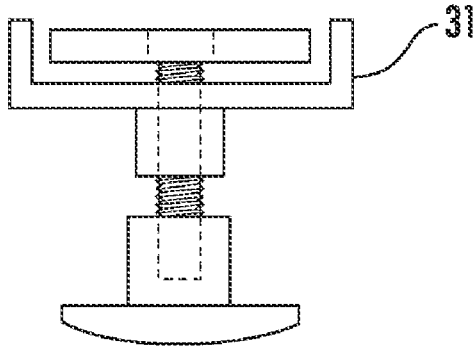
FIG. 6 is a partial cross-sectional view from the top of a screw coupling arrangement of the type which may be employed in connecting the various components of the invention.

FIGS. 4 and 5 illustrate different views of the umbilical line baskets 17 of the invention. As may be appreciated from the figures, screw securing members 31 may be provided on one side to allow the basket 17 to be attached in a detachable manner to the frame 13. A detail of screw securing member 31 is shown in FIG. 6. Other securing arrangements may be employed in the alternative as well known to those of ordinary skill.

Preferably, each basket 17 is made up of a top and bottom frame having an oval shape. The frame of the basket 17 can be made up of two straight angle sections placed about 24 inches apart, each being of about 54 inches by about 1½ inches by about 1½ inches by about 3/16 of an inch. The angled sections are joined together by flat bars. The bottom frame can have metal flats welded between the angle straights and serve as part of the support for the umbilical lines 23. Aluminum mesh can be placed at the curved portions of the basket 17.

Figure 7:
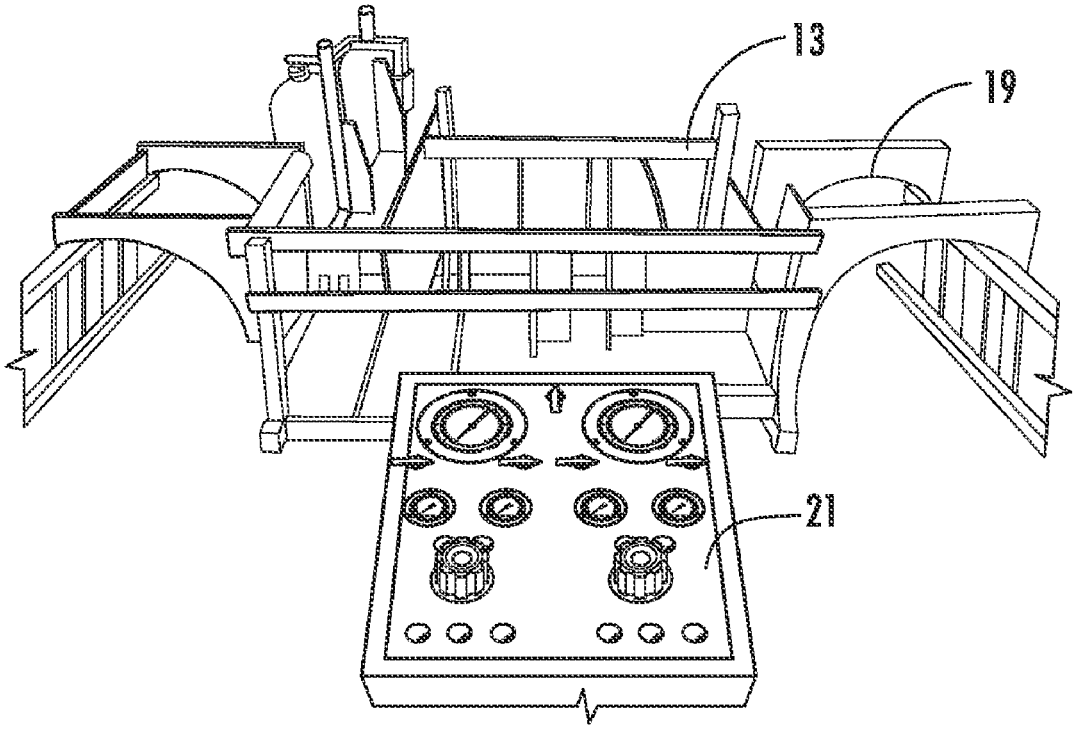
FIG. 7 is a disassembled view of the system of the invention showing various components, including vertically supported SCUBA cylinders within the frame of the system.

The frame 13 typically also includes four detachable and adjustable saddle arms 19 connected thereto as shown in FIG. 7. In addition, the frame 13 includes two rear SCUBA cylinder pack housings as shown in FIG. 7 for carrying two vertically aligned SCUBA cylinder pairs (not numbered).

Figure 8:
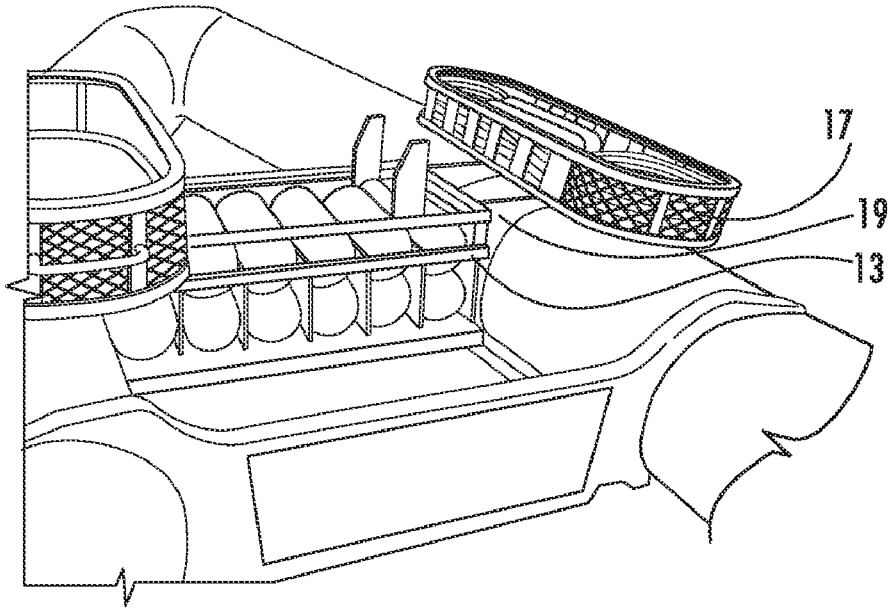
FIG. 8 is a perspective view of the system of the invention in illustrating the frame mounted within an inflatable vessel, and showing were the umbilical baskets are supported on the system.
Figure 9:
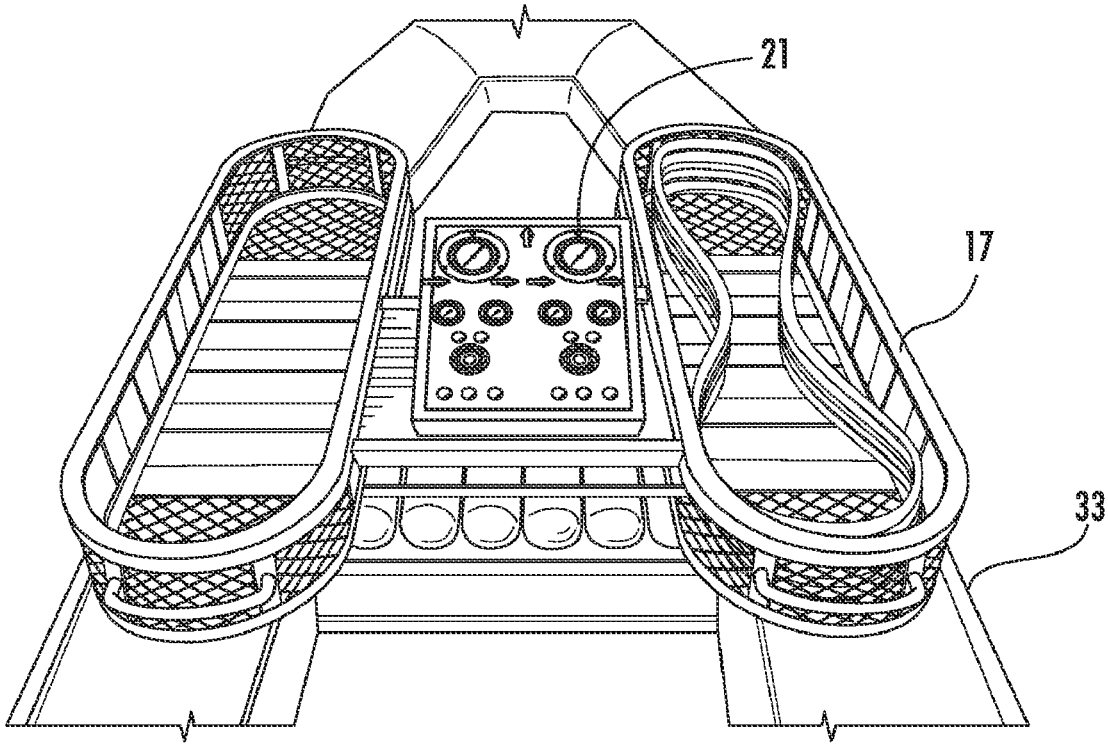
FIG. 9 is a perspective view of an assembled system mounted within a vessel.

FIG. 8 generally illustrates how a basket 17 is supported on top of the saddle arms 19 and may be connected to the frame 13. FIG. 9 further illustrates the system 11 mounted within an inflatable boat and supported by pontoons 33 of the inflatable boat.

Figure 10:
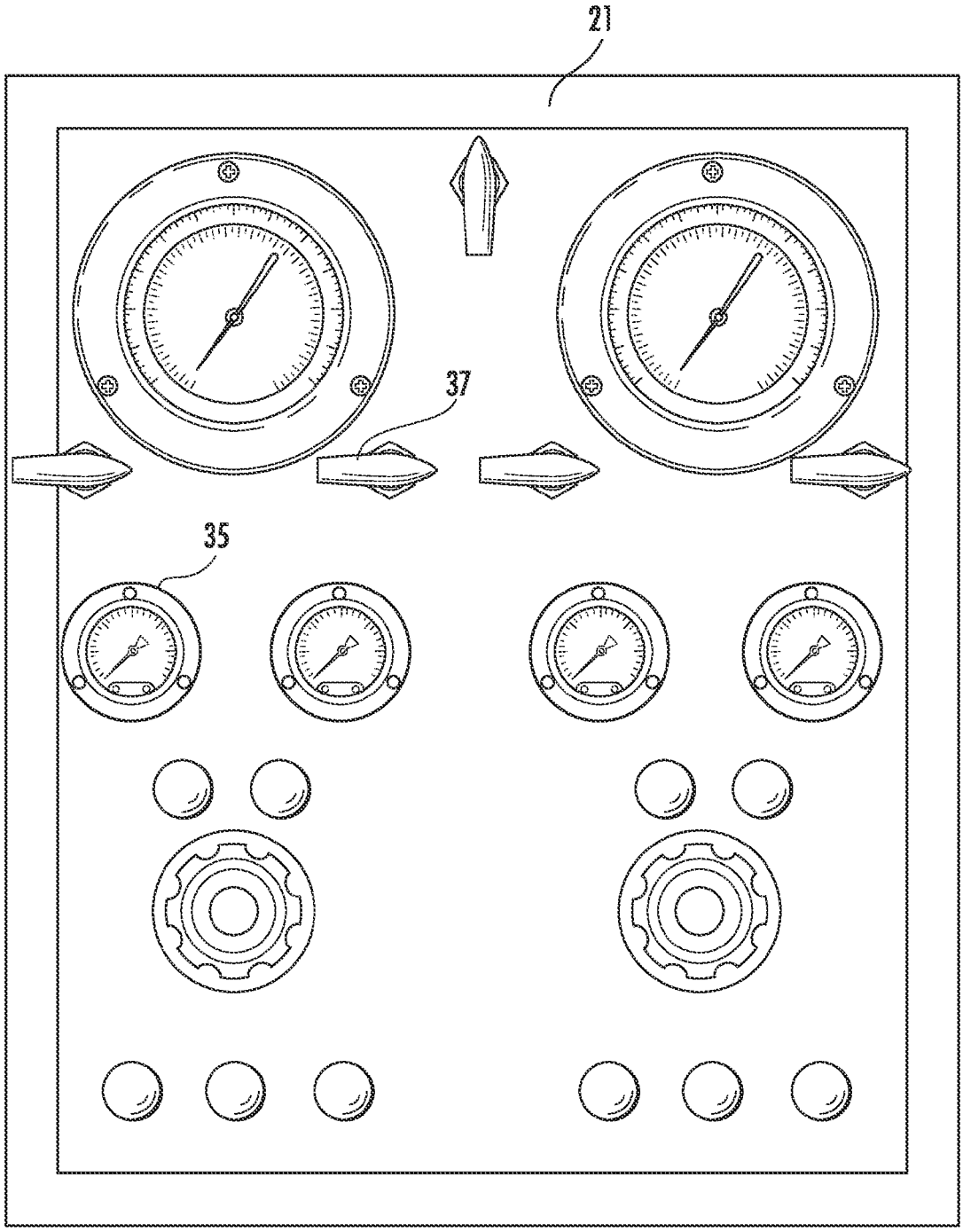
FIG. 10 is a plan view of a control panel of the type employed on the system of the invention showing indicators and controls.

The control panel 21 is shown in plan view in FIG. 10 and includes indicators 35, for example, for displaying cylinder pressure, supply pressure and other pertinent information relative to the system 11 when used by divers. Preferably, the system is designed to support two divers. In addition, controls 37 are provided, for example, to control diver supply, etc. Also associated with the control panel is a communications box (previously shown) which may take various configurations, and is associated therewith. A communication cable is incorporated in the divers' umbilical lines and may be terminated into the communications box 22 through, for example, banana jacks.

In addition, preferably four lift attachment points are provided on the frame 13 (not shown) so that the system can be preassembled and lifted into a boat by lift or crane. Alternatively, as illustrated in the figures, the system 11 can be assembled section by section by two individuals. The components are made light enough that they can be easily lifted manually.

Since SCUBA tank pairs are typically used, the system 11 can be easily resupplied by other inflatable vessels carrying replacement tanks. As a result, the system 11 need not be returned to a base for resupply in order to maintain continuous operation.

The following define an exemplary construction and operation.

Frame Capability

The compartmented frame typically has a carrying capacity of eight Aluminum Twin Scuba Cylinder Packs. Six of these packs are installed within the frame lying on their sides within the six equal compartments. The compartments are formed using sheet and angle members which keep the cylinder packs apart. Two of the rear frame sheets also act as strength members. In addition they form the back sheet for two vertically mounted cylinder pack housings. These housings are attached to the frame by welding or bolting depending on which version is selected. The frame can be mounted either to the rear or the forward position of the boat, depending on where deck space is required.

Main Frame Fabrication

The basic main framework is constructed in two sections which are joined together with side plates. The top rectangular frame is fabricated from 2×45"×1½"×½"×3/16" miter angle and 2×28"×1½"×1½"×3/16" miter angle which forms the frame perimeter. Mounted across this frame longitudinally are two 27⅜"×5"×2"×3/16" profiled channels. These are welded to the frame perimeter angles, the centers of the channels are located 8¾" from the sides of the frame. Between and touching the two channels and the angle perimeter frame is a 25"×22¾"×190" sheet, this is stitch welded to all the members for additional strength. It also forms the base and containment area for the installation of the 2 Diver Control Panel.

Mounted inside these two channels are four lifting points, two either side at 22" centers. The lifting points are fabricated from 14½"×4"×⅜" rectangular flat bar which has a radius top. A ¾" hole is drilled 1½" down from the radius top on the plate centerline. There is also a 9"×4"×1"×⅜" profiled gusset plate stitch welded to the center face of the lifting point for stiffening. This assembly is then welded to a 4½"×4" pre-drilled base plate. The holes are ½" at 2" centers. These lifting points are then welded in position on the channel which is then through drilled to accept ½"-13 cap screws. This arrangement is to provide extra strength at a critical point. These lifting points enable the system to be lifted as a whole, circumstances permitting.

The lifting points also have a secondary purpose, which is to act as guides and securing points for two umbilical baskets. The baskets are mounted on either side of the frame and over the boat pontoons.

On the under side of this framework are mounted 10 pairs of 8"×2½"×2½"×¼" back to back angle division sections. Five pairs are mounted to the front of the frame and five to the rear running longitudinally at 7⁄16" centers commencing from the inside face of the frame joining plates. These angles partially make up the six compartment divisions. This arrangement is duplicated on the bottom rectangular frame. The first two pairs in from the left and right side of the frame front have a gap of 3⁄16" between the angles. This is for the installation of 2×16⅜"×8"×0.190" sheet strength members.

The reciprocal angles at the rear have the same gap as at the front, but accept a sheet 24"×16⅜"×0.190". This sheet protrudes 16" out from the rear of the frame and forms the back support sheet for the two housings which accommodate two vertically mounted cylinder packs. The center pair of back to back angles at the front and rear of the frame have an ⅛" gap between them. This is for the installation of a 16⅜"×8×⅛" sheet which forms a strength member and demarks the Diver 1 and Diver 2 cylinder storage areas.

The bottom rectangular frame is fabricated from 2×45"×1½"×1½"×3⁄16" miter angle and 2×28"×1½"×1½"×3⁄16" miter angle which forms the perimeter. There are two additional profiled angle sections 44⅝"×1½"×1½"×3⁄16" which run across the width. These are welded to the perimeter angles at 8⅜" centers from the outside edge of the back and front perimeter angles. These give additional support for the six Twin Cylinder Packs, and provide a welding point for the 10×8"×2½"×2½"×¼" back to back angle sections. The spacing between these back to back angles is exactly the same as the top rectangular frame. Between the front and rear back to back angles there is a void space of 12" long×7⅜" wide in each compartment. A 12"×7"×⅛" sheet is welded to the base frames in each compartment, the purpose of these are to ensure the cylinder packs slide easily into position. Mounted and welded under the bottom frame are 2×28"×5"×3⁄16" channel feet. The centers of which are located 10 18" in from the sides of the frame. Initially there is a gap of approximately ½" between the feet and the bottom boards of the boat. When four twin cylinder packs are positioned in the frame the feet then just touch the boards. The feet work in conjunction with two sets of adjustable pontoon saddle arms which are mounted on either side of the frame. The arms are bolted to the four 19⅜"×8"×¼" top and bottom frame joining plates (joining plate details follow).

Sun/Weather Roof Fabrication.

A sun/weather roof may be provided on the upper and lower front and rear corners of the frame there are four sets of bored aluminum 2"×2"×2" blocks. The four top blocks are through bored with a 1⁹⁄₁₆" hole, the four bottom blocks are partially bored to 1⁹⁄₁₆" to a depth of 1¾" leaving a ¼" stop foot. The center front face of each block is drilled and tapped for the fitting of a ½"-13 friction stud, to this is attached a threaded ½"-13 hand torque clamping handle.

The purpose of these blocks is to accept four 50½×1½" OD vertically positioned tubular stanchions. This is shown in the Figures. These stanchions have been drilled with a 9⁄16" hole 2" from the top and a ½" nut has been welded over this position. Four 18"×1" round bar extensions are machined at one end to ensure entry into the stanchions, the other end is machined and threaded with a 2"×½"-13 thread. These are now bent 90 degrees at the centre forming a curved support. Two 72"×1½" OD tabular longitudinals are drilled through with 2×9⁄16" holes. The first hole on each tube is drilled 2" from one end, the other hole center is 30" from the first. Welded to each tubular are 6×1½"×½" round bar hooks. The curved sections are secured to the longitudinal by passing the treaded end of the curve through the 9⁄16" holes. A washer, lock washer, and nut complete the assembly. These assemblies can now be fitted to the top of the vertical stanchions and secured. This is achieved by inserting hand torque friction studs and handles into the welded nuts at the top of each stanchion. This overhead frame can now accept the 6'×6' tarpaulin which is fitted with rubber hold downstraps positioned to correspond with the books on the longitudinal tubulars. This sun or weather roof is optional.

Top & Bottom Frame Joining Plates.

Four 19⅜"×8"×¼" joining plates are welded or bolted to join the top rectangular frame to the bottom rectangular frame. They are fitted at each corner having a 12" gap between them. Each plate has four slotted holes which enable the up and down movement of the adjustable pontoon saddle arms. The slotted holes are ½" wide and 2 ½" long and are at 7⅞" centers and 1¼" either side of the plate centerline. The top of the slots are 1½" down from the top edge of the plate. On the front edge of the left front joining plate 6" up from the top of the bottom frame, a 2"×2"×¼" lug is welded. To this lug a 50" length of 17⁄64" aluminum chain is welded. On the front edge of the right front joining plate 6" up from the top edge of the bottom frame, a 3"×2"×¼" lug is welded. This lug has a 1"×5⁄16" slot ¾" from the front edge of the lug. When the cylinder packs have been sealed in the frame, the chain on the left lug is pulled tight across the frame and the nearest link engaged in the slot on the right lug. This prevents the twin cylinder packs sliding backwards out of the frame compartments during rough weather.

Four Adjustable Saddle Arms.

The arms are fabricated from a combination of six sections, comprised of two pieces of 0.190" sheet and 4 pieces of 3⁄16" rectangular flat bar welded together to form a box type structure. A top plate is 17⅝×4"×3⁄16" flat bar and is at right angles to the 12"×4"×3⁄16" back plate. The 4"×4"×3⁄16" front plate is at right angles to the top plate. The saddle plate starts with 30"×4"×3⁄16" flat bar and is rolled to 24" ID. 2" of excess are removed from either end of the curve leaving a 26" finished curve. This curve is welded at the bottom of the back and front plates having 2" of the curve protruding in front of the front plate. The structure is completed by fitting of the two profiled side sheets, all edges are open corner and are fillet welded to give a strong and neat appearance. The back sheet is drilled and fitted with 4×1"×½"-13 cap screws these are then welded in position. The centers of these cap screws correspond with the slotted centers of the top to bottom joining plates. This enables the saddles to move up and down and be locked by nut and locking washer in the required position. It is with this ability of movement that the saddles and frame feet work in conjunction to distribute the system weight using the inflation or deflation of the boat pontoons.

Two Rear Cylinder Pack Housings.

These housings are formed by a protruding vertical 16⅜×16"×0.190" sheet at the rear of the frame. A base sheet 16"×7¾"×0.190" is welded to the bottom of this sheet on the outside edge of the vertical sheet and bottom sheet a radius side sheet 16⅜"×7¾"×0.190" is welded to form a containment area for the vertical cylinder pack. A ½" hole is drilled in the back sheet on the center line and 2" from the top of the back sheet. In this hole a 8"×½"-13 stud bolt is welded, a 12"×2"×⅜" drilled securing strap is then positioned on the stud. The strap is tightened against the cylinder pack by the use of a threaded hand torque clamping handle. This prevents any movement of the Vertical Twin Cylinder Pack.

Umbilical Baskets.

Dimensions. Length 78"×Width 24"×Height 10".

Each umbilical basket includes of a top and bottom frame whose shape is oval. The frame is made up from two 54"×1½"×1½"×3/16" straight angle sections placed 24" apart. These are joined together by 2×1½"×3/16" flat bars which have been rolled to a 12" radius, which forms the end curves. To tie in with the angles, curved flat profiles are cut from a 0.190" sheet and are welded to the inside of the rolled flat bar. The bottom frame has 5×21"×4"×3/16" flats welded between the angle straights at 11" centers from the flame center. These are part of the support for the diver's umbilical. To complete the bottom frame supports, two pieces of expanded aluminum mesh 24"×16"×0.125" have been profiled to fit the two curved end areas of the frame. They are then spot welded to the angle and where they overlap 1" on the last of the 21"×4"×3/16" supports at either end. The top and bottom frames are joined together to form the basket by 10×7"×4"×3/16" flats, 5 either side. These are positioned to correspond with the 5×21"×4"×3/16" flats on the bottom. An additional 4×2"×3/16" flat bars are welded at 11" centers on the end curves, 2 either end. They give extra support and are used as attachment points for two curved lifting handles bent from ¾" rod. This enables the baskets to be lifted manually and positioned on the lifting points where desired. To complete the umbilical containment, 2×48"×9½"×0.125 expanded aluminum mesh sections are rolled to a 12" radius. These curved sections are placed inside the curved ends of the frame, and are spot welded to the angles and the last two vertical 7"×4"×3/16" flats. On one side of the top frame corresponding to the 5 vertical flats, 5×5"×1½"×3/16" channel clamping brackets are welded. In the center of each bracket, a 9/16" hole has been drilled. A ½"-13 nut is then welded over this hole which accepts a 1" ½"-13 friction stud fitted with a hand torque clamping handle. These are used to clamp the umbilical basket onto the lifting points. Finally, on the top frame are welded 4×2½"×¼" lifting pad eyes. Each has a radius top and is drilled with a 1⅝" hole on the centerline 1" from the top of the radius. They are positioned at 50" centers, 25" either side of the frame centerline.

Communications Box Frame & Swing Arms.

Dimensions. Length 10¾"×Width 24"×Height 4½".

This frame is fabricated from 2×16½"×1"×1" and 2×10¾"×1"×1" mitered angle. This is welded together with one angle leg pointing down the other forms the face of the perimeter. Welded to and under this frame are two 8¾" wide×4½" deep×2"×⅛" U shaped forms, these are the supports for the communications box. Each of the 10¾"×1"×1" sides is drilled with a ½" hole in the center of the down angle leg. A 1"×½"-13 cap screw is inserted into each hole and secured with a 4"×⅞"×½-13 partially threaded both end hexagonal standoff. The other end of the standoff accepts a ½"-13 stud to which is attached a threaded hand torque clamping knob. This arrangement enables the frame to be swung into the desired position and locked onto the two swing arms. Arms are made from 2×30"×2"×¼" flat bars which have radiuses at either end. An end that accepts the communication box has a 9/16"×1" vertical slot at 1½" center from the radius. The other end of the arm has a ½" hole drilled 1" center from the radius. These holes fit onto two captive ½"-13 cap screws mounted on each side of the dive panel (details fellow). This allows the frame to be moved up or down into the required position.

Cylinder Pack Description.

As an example, the cylinders used in this system are manufactured by the Luxfer Company from 6061T6 aluminum alloy. These cylinders meet the requirements of the U.S. Department of Transportation (DOT), and the Canadian Transport Commission (TC).

They are made up in two cylinder packs, one cylinder is fitted with a left hand valve (VA300L). The other cylinder has a right hand valve fitted (VA300R). The valves are connected together with a crossbar (VC0V0) which determines the between-cylinder spacing. The valve take off connection is a ⅝-¼ DIN fitting, this is for the connection of the flexible Synflex hoses from the Dive Control Panel (details follow). The cylinders are braced to prevent movement with 2×2½"×3/64" stainless steel bands. Prior to installation, the bands have 2½"×1/16" self adhesive natural sponge rubber applied to their inside surfaces. This is to prevent interaction between dissimilar metals occurring. The bands are then slipped over the cylinders to their required position, and tightened using 2×3½"×¼" stainless steel cap screws. The cylinders are now ready to be charged to their service pressure.

Cylinder Specifications.

| | | | | | |
|---|---|---|---|---|---|
| Cylinder length | 26.060". | Diameter | 7.25" | Weight | 31.38 lbs. |
| Water volume | 678 cu.ins. (.0392 cu. ft.) | Service pressure | 3,000 psi. | Capacity | 80 cu. ft. |

Capacity of 8 twin cylinder packs is 1,281 cu. ft. of air or mixed gas.

Weight of 8 twin cylinder packs including valves and crossbars is 514 lbs.

With 2 additional twin cylinder packs carried in the boat, total capacity will be increased to 1,601 cu. ft. The total weight will now be 643.5 lbs. These extra cylinders can be stored in the stand-by divers umbilical rack to keep the deck area clear. Depending on the size of the boat, more additional cylinders can be carried. In the event this is not possible, the boat can return to the parent vessel. Empty cylinders can be exchanged for pre-charged cylinders ensuring a quick turn around. Alternatively another small vessel can travel to the system with replacement cylinders.

A comparable system using large storage cylinders 51 inches in length and weighing 118 lbs. Five of these cylinders would be required and would give a total volume of 1,405 cu. ft. @ 2,400 psi for a total weight of 590 lbs. There is no change over facility available with this type of system, and charging must be carried out on the parent vessel. Charging could take up to one hour or more depending on the capacity of the high pressure compressor. These cylinder pairs can be easily carried by an individual.

2 Diver Control Panel.

The 2 diver control panel has a dimension of: Length 27½"×Width 22¼"×Height @ front 10⅛.

Construction Details.

An angled rectangular frame is constructed from 1"×1"×⅛" angle. Top and bottom frames have mitered corners welded at the joints. Two 8"×1"×1" front verticals have a slight angle on top which corresponds to the angle of the panel face. This angle applies to the two 3"×1"×1" rear verticals. When these are welded together, this forms the basic frame. There are two intermediate verticals centered 7" from the front of the front verticals. A ½" hole is drilled through the outside angle face 5" from the bottom of the frame. In this hole is positioned a 1"×½"-13 cap screw which is spot welded to the angle. These are for the fitting of the communication box swing arms. The complete framework is clad with ⅛" profiled sheet. The front and back sheets have six holes of varying diameters to accept tube penetrators. The side sheets each have one hole which corresponds to the protruding 1"×½" cap screws on the sides of the frame. The panel face has a total of 25 holes of varying sizes to accept regulators, gauges and valves which make up the 2 diver control panel. All the cladding is secured in position by adequate use of ⅜"×8-32 Phillips flathead stainless steel screws. Prior to fitting out of the panel and to prevent interaction between these screws and the aluminum components, the complete assembly will be given a black powder coating. The perimeter of the completed panel is trimmed with 1"×1"×⅛"chromed aluminum angle. This is secured using ½"×8-32 Phillips/slotted combination stainless steel machine screws. Under each screw head is a black hard fiber washer to prevent interaction of the dissimilar metals. Mounted in the center of the front and rear panel sheets are 2×6"×¾" aluminum carrying handles secured with ¼"-20 machine screws.

Dive Control Panel Components and Fit Out.

The components used in the makeup of this panel system need to be the most reliable available in the market. The components include regulators, depth monitoring gauges, life support gauges, indicating gauges, valves, and compression fittings. The panel complies with IMCA guidelines, inasmuch that each diver has his own independent supply system. In the event of a failure of the deployed diver's supply system, there is a cross over valve which allows him to be transferred to the stand-by diver's supply for return to the surface.

All fittings mentioned on the high pressure side of the system are of stainless steel. The lowest pressure rating is 3000 psi for the inline chrome brass bleed valve which is incorporated in the supply line. All low pressure fittings are rated in excess of 2000 psi. Each diver is allocated four twin cylinder packs, three of which lie horizontally in the frame, and one vertically at the rear of the frame. Interconnection of Diver One's three horizontal cylinders to the Dive Panel. This commences with the insertion of a ⅝-¾ DIN hand wheel connector into the lower cylinder valve of the cylinder manifold on each cylinder pack. To the ¼ male end of this DIN fitting a female street elbow is connected. To the male end of this is connected the double female bleed valve fitted with a ¼ Triple Loc male connector.

On the front panel sheet, passing through three of the pre-drilled penetrator holes are 3×¼ Female Bulkhead Tube Connections, one for each of a diver's three inlets. The connectors have the ¼ female pipe thread end on the outside of the panel, and to this a ¼ Triple-Loc Male Elbow has been fitted. Between this elbow and the Triple-Loc Male Connector fitted to the bleed valve, a ¼×5000 psi rated Synflex flexible hose is connected. This hose completes the hook up between the cylinders and panel. The opposite end of the Female Bulkhead Tube Connector is a tube compression fitting. To this is fitted a ¼ stainless steel bent tube which connects to a ¼ Non Return Valve ("NRV"). This arrangement is common to all three diver inlets. From the opposite end of an NRV, another ¼ pre-bent stainless steel tube connects to a high pressure needle valve. These valves have color coded handles to indicate which supply is being used. A first diver's first cylinder is Black. The second supply is Blue. The third supply is Yellow and his emergency supply is Red.

The supply to the red valve comes from the vertical cylinder pack at the rear of the fame. All the connections to this cylinder pack and the panel are identical to those at the front. The connection to the red needle valve is by a straight length of ¼ stainless steel tubing from the Female Bulkhead connector compression end. The opposite end of the tube has a 180 degree bend for connection into the rear of this valve. All valves are interconnected by various short lengths of ¼ stainless steel tube, which are then connected to ¼ compression elbows and tees.

This configuration forms a manifold, which terminates with a single ¼ stainless steel bent tube. This tube connects to a ¼ Male Elbow which is fitted to a ½ to ¼ Pipe Thread Reducer. This assembly is screwed into a High pressure inlet side of a Pressure Control Regulator. It is within this part of the supply system that the ability to change out cylinder packs exist (see Operational Procedures). On the front body of the regulator are 2×¼ female ports, one for high pressure and one for low pressure. The high pressure port is fitted with a ¼ stainless steel Male Elbow, to this a pre-bent ¼ stainless steel tube is connected. The tube is then fitted to the inlet side of a ¼ Needle Valve located above and to the right of the regulator. A second pre-bent tube is fitted to the outlet side of the valve. This is then fitted to a Female Connector on the back of a 2½" indicating gauge. The gauge centre is located directly above the valve. The low pressure arrangement is exactly as for the high pressure, the only difference being the ¼" tube is copper and the valve is brass. The low pressure Life Support Gauge is fitted to the left of the indicating gauge above the valve. A ½-⅜" pipe thread reducer fitted with a ⅜" Male Elbow is connected to the outlet side of the regulator. From this a ⅜" copper tube is directed to the inlet side of Diver One's supply valve. Incorporated in this supply line is a ⅜" union tee fitted with a ⅜-¼" reducing union. The purpose of this is to enable a ¼" copper tube to be diverted to the inlet side of the diver's ¼ Depth Monitoring Valve. From the outlet side of the depth monitoring valve a ¼ union tee is fitted with one port facing upwards. From this a pre-bent copper tube connects to a Female Connector on the rear of the 6" diameter depth monitoring gauge (Pnemofathometer). From the remaining port a ¼" copper tube connects to a ¼" Female Bulkhead Connector which passes through one of the pre drilled holes in the rear panel sheet. To this is fitted a ¼" Triple-Loc Male Connector which in turn connects to the depth monitoring hose incorporated in the diver's umbilical.

A ⅜" copper tube from the outlet side of the diver's supply valve is fitted with a ⅜" Union Tee, one port facing upwards. From this, a pre-bent ⅜" copper tube is connected to a Union Elbow, which is connected to the crossover valve previously mentioned. From the remaining port in the union tee, another pre-bent ⅜" copper tube connects to a ⅜" Non Return Valve ("NRV"). This NRV is connected to a ⅜" Female Bulkhead Connector which passes through one of the pre drilled holes in the rear panel sheet. The Female Bulkhead Connector is fitted with ¼-⅜" Triple-Loc Male Connector to which the diver's umbilical supply hose is connected.

A Diver Two side of the panel is exactly as described for Diver One. With the opening of the Crossover Valve, the supply can be directed One to Two or Two to One.

Communications Hook Up.

A communications box is positioned inside the swing arm containment frame and the top cover removed for access. A communications cable which is incorporated in the diver's umbilical and is terminated with Banana Jacks. These are jacked into the appropriate take offs on the communication box panel. The system is ready for use.

To further enhance the aesthetic appearance of the panel fascia, and under the lock nuts of all valves, penetrators and around the regulators, machined chrome brass washers or rings are mounted. Also, to prevent interaction of these with the aluminum, hard black fiber washers are inserted between both metals.

System Installation.

The system can be pre-assembled and lifted into the boat by davit or crane. Or it can be assembled by two men section by section. All components can easily be lifted manually by two men. Once the system is in the desired position, the pre-dive checks can be carried out.

Pre-Dive & Cylinder Contents Check.

In order to ensure safety, the following checklist procedure is typically followed:

Ensure that both diver's umbilicals are connected and tightened on the divers mask or helmet.

Check all appropriate umbilical connections to the panel are properly connected and tight.

Check the contents of the bale out cylinder on the cylinder contents gauge. Check that the first stage is connected to emergency supply valve on a mask or helmet and connections are tight.

Plug in and test diver's communication lines.

Ensure that all cylinder, bleed and panel valves are closed, and that regulators are backed off.

Open Diver One high pressure isolation valve to indicating gauge.

Open supply valve on a first diver's cylinder pack number one.

Open the first diver's number one supply valve on panel (black handle). The cylinder contents will be shown on the indicating gauge. If the contents are satisfactory, record result and close the cylinder supply valve. Bleed the line pressure down through the free flow valve on the mask or helmet, close panel valve number one. The isolation valve remains open.

Repeat this procedure with all cylinder packs for both divers.

On completion of the cylinder contents check, all cylinder and panel valves should be closed.

Open both diver's low pressure isolation valves to life support gauges.

Open supply valve on the first diver's cylinder pack number one.

Open the first diver's number one supply valve on panel. Screw down on the regulator hand knob until required supply pressure is registered on the life support gauge.

Open the first diver's number one supply valve on panel. Screw down on the regulator hand knob until required supply pressure is registered on the life support gauge.

Open the first diver's main supply valve to mask or helmet, check flow with the free flow valve.

Repeat this procedure on the second diver's supply system.

Close the first diver's main supply valve, leave the second diver's supply valve open, open the crossover valve and check flow to the first diver mask or helmet. Reverse and repeat the operation with the second diver.

Assuming all tests proved satisfactory, the system is ready for diving.

Conducting the Dive & Change Over Procedure.

Once on location the dive can commence. The first diver is dressed in and standard bale out and communications checks an carried out.

Open both divers' two cylinder pack supply valves.

Open both divers' number one panel supply valves (black).

The required manifold pressure is set on both regulators and indicated on the life support gauges.

The first diver enters the water and the dive commences.

The Diving Supervisor will have a pre-determined cylinder residual capacity planned, which will depend on the depth of the dive. This could be anywhere between 300 to 500 psi.

When this pressure is reached, all the Supervisor has to do is open panel supply valve number two (blue). As each supply line has an inline non-return valve, one cylinder cannot decant back into the other. The diver is unaware of this change over.

Close the supply valves on cylinder pack number one and panel supply valve number one and bleed the inline pressure contained it the flexible hose. This is done by opening the small screw valve on the bleed assembly.

The DIN connection on cylinder pack number one can now be disconnected, and the cylinder withdrawn from the frame. This is replaced by a fully charged cylinder pack and connections re-made. The cylinder pack supply valve can now be opened. When the residual capacity is again reached, the diver can either be returned to cylinder pack number one or moved on to cylinder pack number three (yellow). The red pack will always be retained for emergency use only.

Depending on how many spare cylinder packs are carried, this procedure can be carried out indefinitely.

In the event there is a great deal of work to be done in a certain location, the following can be considered. Carrying too many cylinder packs could become impractical due to the weight, the boat could return to the parent vessel and exchange empty cylinders for full ones, or another vessel could resupply the system. In conclusion, with the greatly reduced weight of this system, at the end of each day diving, the boat and system can be lifted onboard together. With the larger systems, the system is recovered separately from the boat. One other feature is, if the boat is required for another purpose, it would only be necessary to remove the dive control panel and umbilical racks. These racks can be stored one on top of the other, thus saving deck space.

The system should weigh approximately 1,000 lbs, aluminum being two thirds lighter than steel but as strong.

Having thus generally described the invention, the same will become better understood from the appended claims in which it is set forth in a nonlimiting manner.

What is claimed is:

1. A portable surface air supply system, the system comprising:

a main cylinder frame having a plurality of air cylinder nesting receptacles for having respective air cylinders received therein;

detachable umbilical tube baskets extending from respective opposite sides of said frame for carrying umbilical tubes therein, wherein said umbilical cord baskets are arranged for being connected to said frame to extend from the frame toward respective outboard sides of a vessel; and a dive control panel comprised of diver supply valves, regulators, depth gauges and cross over valves connected for controlling air flow for respective divers, monitoring diver depth and crossing over to a new air supply in the event of failure of an air supply to a specific diver.

2. The system of claim 1, wherein said dive control panel further comprises life support gauges for monitoring diver physiological status and further comprises indicting gauges for indicating air supply status.

3. The system of claim 1, further comprising eight air cylinder pairs mounted on said frame, and umbilical tubes connectable to said air cylinder pairs for supplying air to at least one diver on a dive.

4. The system of claim 1, wherein said main cylinder frame has outboard adjustable pontoon saddle arms having a cylindrical cross-section for being supported in a vessel having outboard pontoons to thereby be supported in the vessel on said pontoons.

5. The system of claim 1, wherein said main cylinder frame is adjustable in size for being adjusted to fit in a variety of different size vessels.

6. The system of claim 4, wherein said saddle arms are detachable from said main cylinder frame.

7. The system of claim 1, wherein said main cylinder frame comprises lifting points for connecting lifting lines thereto for allowing the main cylinder frame to be lifted as a whole.

8. The system of claim 4, further comprising four saddle arms.

9. The system of claim 8, wherein said saddle arms are adapted for having said umbilical tube brackets mounted thereon.

10. The system of claim 2, wherein said dive control panel further comprises indicators connectable to air cylinders for indicating cylinder pressure and air supply pressure.

11. The system of claim 3, wherein the dive control panel and umbilical tubes are configured for supplying air to two divers.

12. A method of conducting diving operations, the method comprising:

providing a portable surface air supply system, the system comprising:

a main cylinder frame having a plurality of air cylinder nesting receptacles for having respective air cylinders received therein;

detachable umbilical tube baskets extending from respective opposite sides of said frame for carrying umbilical tubes therein, wherein said umbilical cord baskets are arranged for being connected to said frame to extend from the frame toward respective outboard sides of a vessel; and a dive control panel comprised of diver supply valves, regulators, depth gauges and cross over valves connected for controlling air flow for respective divers, monitoring diver depth and crossing over to a new air supply in the event of failure of an air supply to a specific diver;

connecting respective umbilical tubes to corresponding divers and to twin air cylinders in the cylinder frame;

testing communication lines in the umbilical tubes;

opening diver supply valves on the dive control panel and checking if valve indications are acceptable for all cylinders; and commencing diving operations.

13. The method of claim 12, further comprising switching a diver's supply from one twin air cylinder to another twin air cylinder when the supply in the one twin air cylinder is being depleted.

14. The method of claim 13, further comprising conducting said switching when the one twin air cylinder has a pressure of about 300 to about 500 psi.

* * * * *